US007396074B2

(12) United States Patent
Wiecek

(10) Patent No.: US 7,396,074 B2
(45) Date of Patent: Jul. 8, 2008

(54) LINKAGE MECHANISM FOR A RECLINER CHAIR

(75) Inventor: Glenn N. Wiecek, Shelbyville, KY (US)

(73) Assignee: L & P Property Management Company, South Gate, CA (US)

( * ) Notice: Subject to any disclaimer, the term of this patent is extended or adjusted under 35 U.S.C. 154(b) by 0 days.

(21) Appl. No.: 11/759,506

(22) Filed: Jun. 7, 2007

(65) Prior Publication Data

US 2008/0001442 A1 Jan. 3, 2008

Related U.S. Application Data

(60) Provisional application No. 60/811,832, filed on Jun. 8, 2006.

(51) Int. Cl.
*A47C 1/02* (2006.01)

(52) U.S. Cl. ..... 297/85; 297/68; 297/84

(58) Field of Classification Search ..... 297/84, 297/85

See application file for complete search history.

(56) References Cited

U.S. PATENT DOCUMENTS 3,767,257 A * 10/1973 Rogers et al. ..... 297/85
3,768,859 A * 10/1973 Rogers et al. ..... 297/85
3,813,150 A * 5/1974 Katz et al. ..... 297/85 X
4,071,275 A * 1/1978 Rogers, Jr. ..... 297/85
4,108,491 A * 8/1978 Rogers, Jr. ..... 297/85
4,249,772 A * 2/1981 Rogers, Jr. ..... 297/85
4,306,746 A * 12/1981 Crum ..... 297/85
4,319,780 A * 3/1982 Rogers, Jr. ..... 297/85
4,350,386 A * 9/1982 Rogers, Jr. ..... 297/85
4,350,387 A * 9/1982 Rogers, Jr. ..... 297/85
4,418,957 A * 12/1983 Rogers, Jr. ..... 297/85
4,544,201 A * 10/1985 Rogers, Jr. ..... 297/84 X
4,577,902 A * 3/1986 Crum ..... 297/85
4,662,673 A * 5/1987 Crum ..... 297/68
5,192,113 A * 3/1993 Wiecek ..... 297/85
5,704,686 A * 1/1998 May ..... 297/85 X
5,772,278 A * 6/1998 Kowalski ..... 297/85
6,231,120 B1 5/2001 Wiecek
6,540,291 B2 * 4/2003 Hoffman et al. ..... 297/85
6,769,734 B2 * 8/2004 Tacker ..... 297/85 X
7,040,692 B1 * 5/2006 Pine ..... 297/85
7,147,278 B2 12/2006 Johnson et al.

* cited by examiner

*Primary Examiner*—Rodney B. White
(74) *Attorney, Agent, or Firm*—Shook, Hardy & Bacon, L.L.P.

(57) ABSTRACT

This invention is related to a recliner chair having a footrest mechanism and a recliner mechanism. The recliner chair includes a footrest, a seat, back, and a pair of spaced apart armrests. The recliner mechanism, in one aspect, broadly includes a base plate, a seat mount plate, a recline link, a seat lift link, a control linkage, and a back linkage. The carrier link couples the base plate to the back linkage while the full recline link couples the carrier link to the base plate. The control linkage is coupled to the base plate, the back linkage, and the footrest extension linkage and cooperates therewith to move the footrest mechanism between the open and closed positions. Further, the control linkage cooperates with the back linkage to move the backrest between the upright position and the fully reclined position.

6 Claims, 5 Drawing Sheets

LINKAGE MECHANISM FOR A RECLINER CHAIR

CROSS-REFERENCE TO RELATED APPLICATIONS

This application claims priority to commonly owned U.S. provisional application Ser. No. 60/811,832, filed Jun. 8, 2006, incorporated by reference in its entirety.

STATEMENT REGARDING FEDERALLY SPONSORED RESEARCH OR DEVELOPMENT

Not applicable.

BACKGROUND OF THE INVENTION

This invention relates to a linkage mechanism for a recliner chair, and more particularly to a linkage mechanism for a recliner chair that achieves improved motion from the open, reclining, TV position to the fully reclined position.

Linkage mechanism for recliner chairs are common in the furniture industry. Typically, recliner chairs have extendable footrests that allow the user to recline in several positions. For instance, a conventional recliner chair moves between a closed, stowed position; an open, reclining TV position; and a fully reclined position. However, improved motion and movement are desired when the chair is moved from the open, reclining, TV position to the fully reclined position. Specifically, improved movement of the rear portion of the seat with respect to the front portion of the seat is needed when the chair is moved from the open, reclining, TV position to the fully reclined position. More specifically, when the chair is moved from the open, reclining, TV position to the fully reclined position, it is preferred that the rear of the seat move upwardly at a faster rate than the front portion of the seat to provide a more horizontal orientation of fully reclined position for the user.

Thus, while recliner chairs are known, there remains a need for an improved recliner chair that provides improved movement between seating, reclining, and fully reclined positions.

BRIEF SUMMARY OF THE INVENTION

This Summary is provided to introduce a selection of concepts in a simplified form that are further described below in the Detailed Description.

Accordingly, the present invention provides a linkage mechanism for a recliner chair having improved movement between seating, reclining, and fully reclined positions. The recliner chair can be moved between a closed, chair position, position one, as shown in FIGS. 1-3; an open, recliner, TV position, position two, as shown in FIGS. 4 and 6; and an open, fully reclined position, position three, as shown in FIG. 5.

In one aspect, the recliner chair includes a base, a seat, a footrest, a backrest, and a pair of linkage mechanisms mounted on the base on opposite sides of the chair. Each of the linkage mechanisms includes a recliner mechanism and a footrest mechanism. The recliner mechanism is coupled to the base. The footrest mechanism is connected to the recliner mechanism by a footrest extension linkage. The footrest extension linkage serves to unlock the footrest mechanism thereby allowing the weight of the user, along with the drive mechanism, to move the chair from the chair position to the recliner position.

The recliner mechanism broadly includes a base plate, a seat mount plate, a recline link, a seat lift link, a control linkage, and a back linkage. The carrier link couples the base plate to the back linkage while the full recline link couples the carrier link to the base plate. The control linkage is coupled to the base plate, the back linkage, and the footrest extension linkage and cooperates therewith to move the footrest mechanism between the open and closed positions. Further, the control linkage cooperates with the back linkage to move the backrest between the upright position and the fully reclined position.

In operation, to move the recliner from the closed, chair position, position one, as shown in FIGS. 1-3 to the open, recliner TV position, position two, of FIG. 4, the user rotates a release lever or other activation means rearwardly. The rearward rotation of the lever or other activation means serves to unlock the footrest extension linkage, thereby allowing the weight of the user to move the linkage mechanism from position one to position two. The unlocking of the footrest extension linkage also allows the control mechanism to assist in moving the footrest mechanism from the closed, chair position to the open, recliner position. To fully recline the recliner chair the user simply applies a force to the backrest. The rearward force engages the back linkage. This rearward motion of the back linkage engages the seat mount plate and the lift link and causes the seat to rise and moves the linkage to the fully reclined position. Specifically, the rearward motion of the back linkage causes the rear portion of the seat mount plate and lift linkages to raise at a greater rate than the front portions. As such, the orientation of the lift link and thus the seat is typically close to horizontal thereby affording the user a more comfortable fully reclined position.

As will be seen from the detailed description that follows, the invention provides a recliner chair that contains a recliner mechanism and a footrest mechanism that achieve superior movement between the closed, chair position, position one, as shown in FIGS. 1-3 to the open, recliner TV position, position two, of FIGS. 4 and 6 to the open, fully reclined position, position three, as shown in FIG. 5. Additional advantages and novel features of the invention will be set forth in part in a description which follows and, in part, will become apparent to those skilled in the art upon examination of the following, or may be learned by practice of the invention.

BRIEF DESCRIPTION OF THE SEVERAL VIEWS OF THE DRAWING

In the accompanying drawings which form a part of the specification and which are to be read in conjunction therewith, and in which like reference numerals are used to indicate like parts in the various views.

DETAILED DESCRIPTION OF THE INVENTION

Figure 1:
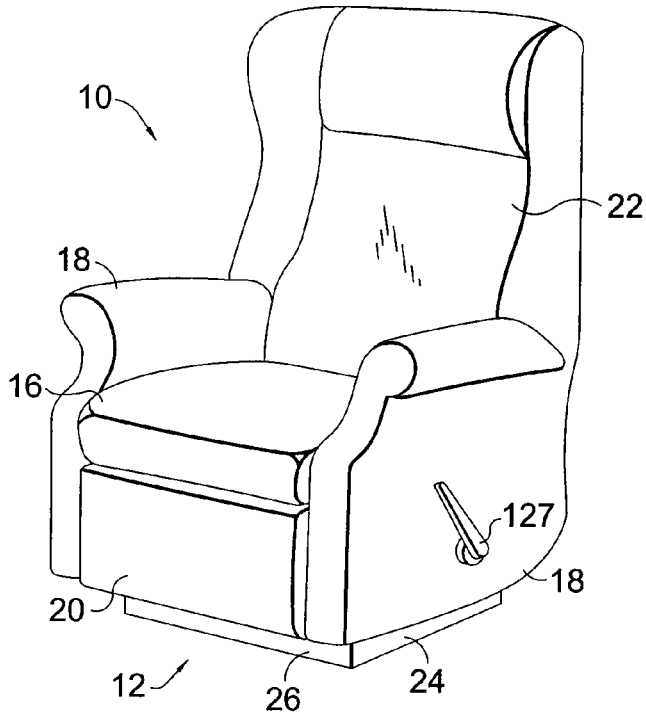
FIG. 1 is a front perspective view of a recliner chair in the closed, chair position according to the present invention.

Referring to the drawings in greater detail and initially to FIG. 1, a recliner chair is shown and designated generally by the numeral 10.

Figure 2:
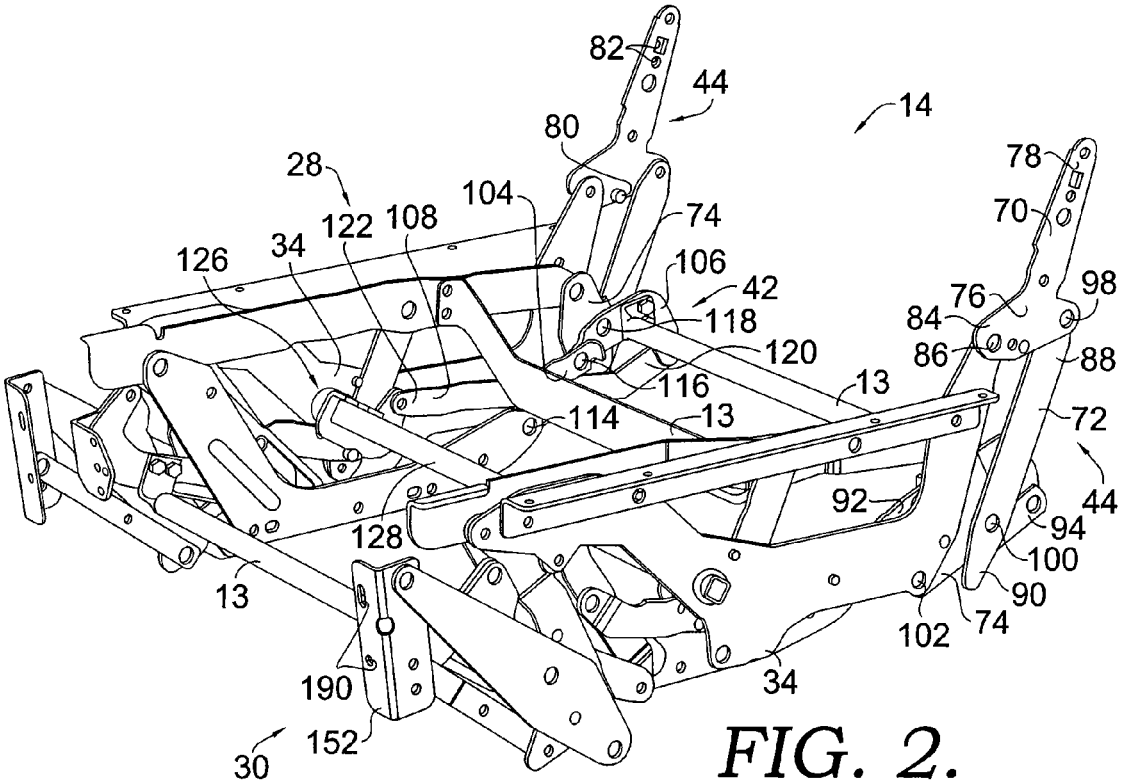
FIG. 2 is a front perspective view of a linkage mechanism of the recliner chair, showing the linkage mechanism in a closed, chair position.
Figure 3:
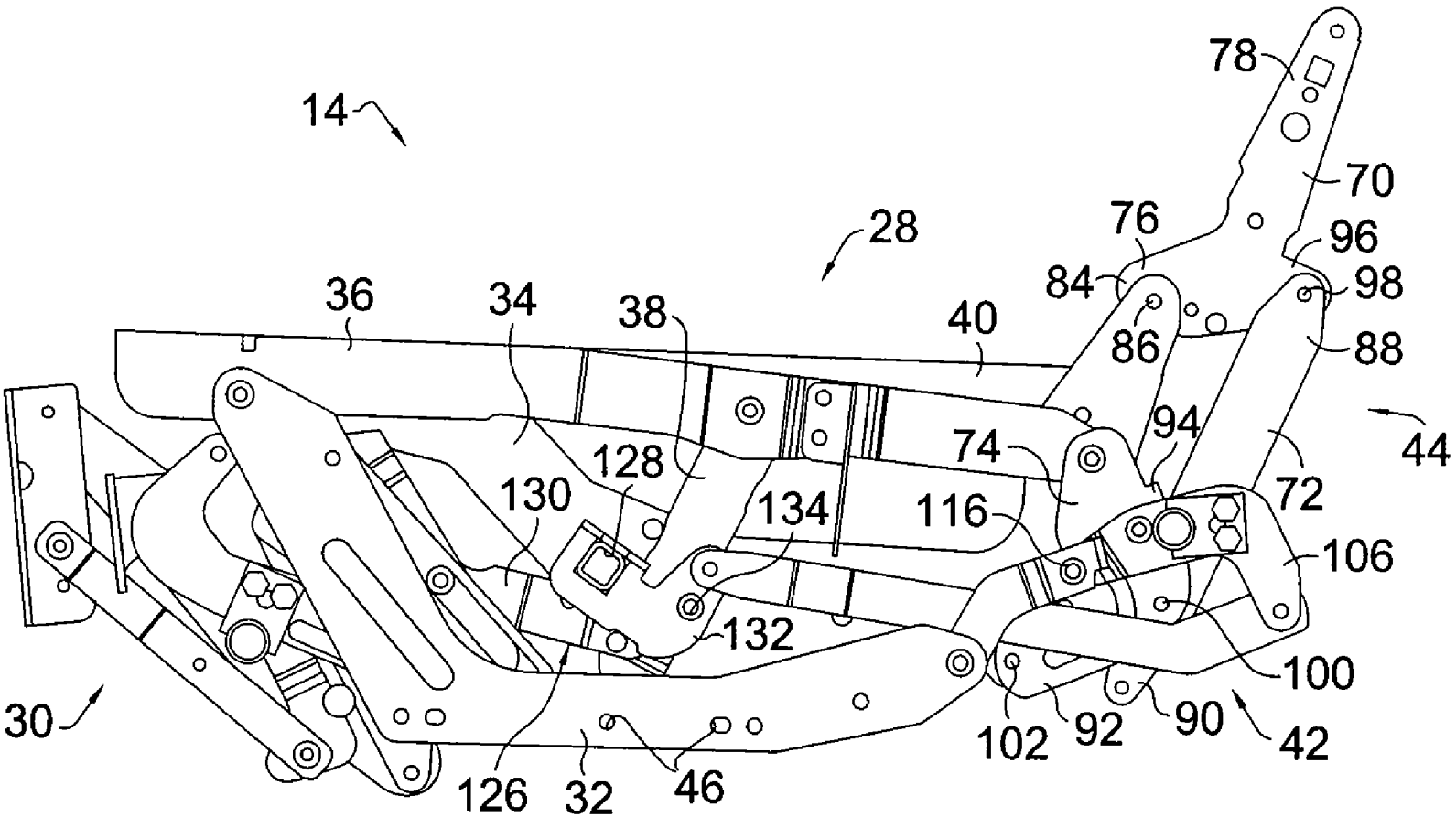
FIG. 3 is a cross-sectional view of the linkage mechanism, showing the linkage mechanism in a closed, chair position.
Figure 4:
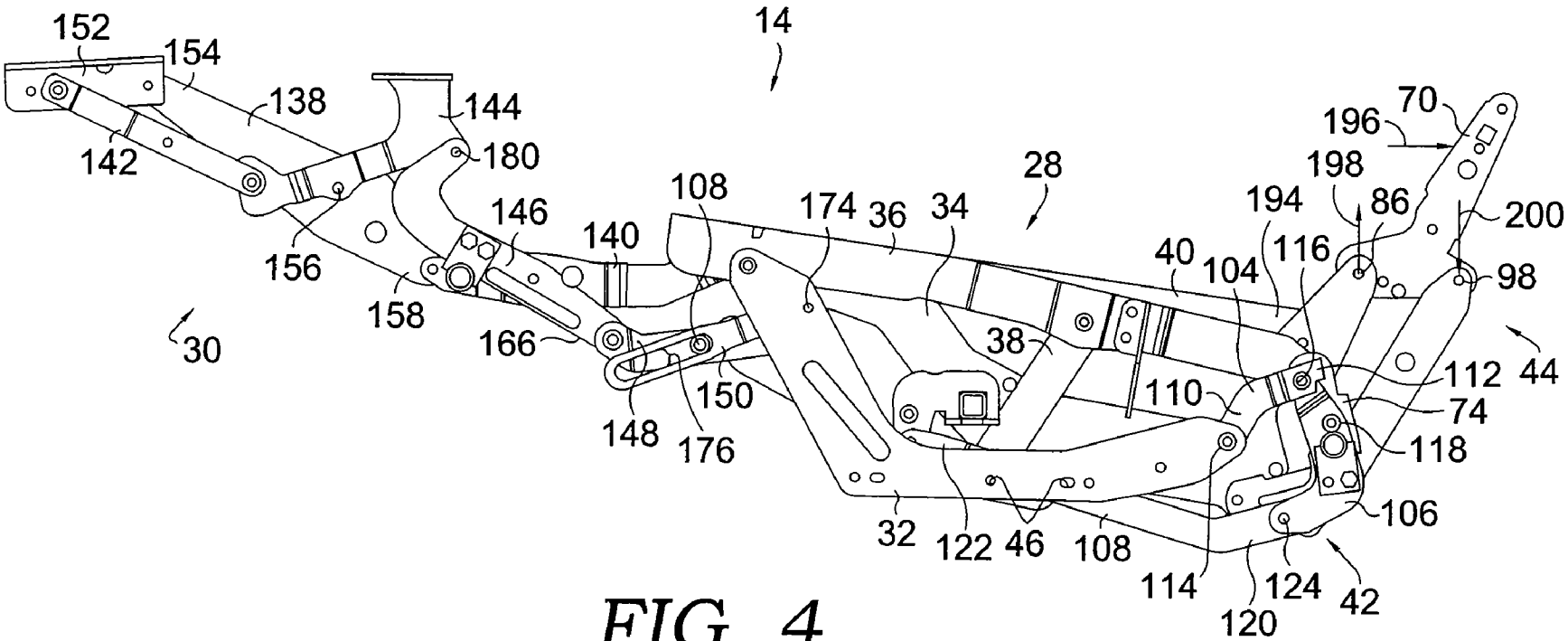
FIG. 4 is a view similar to FIG. 3, but with the linkage mechanism in an open, recliner, TV position.
Figure 5:
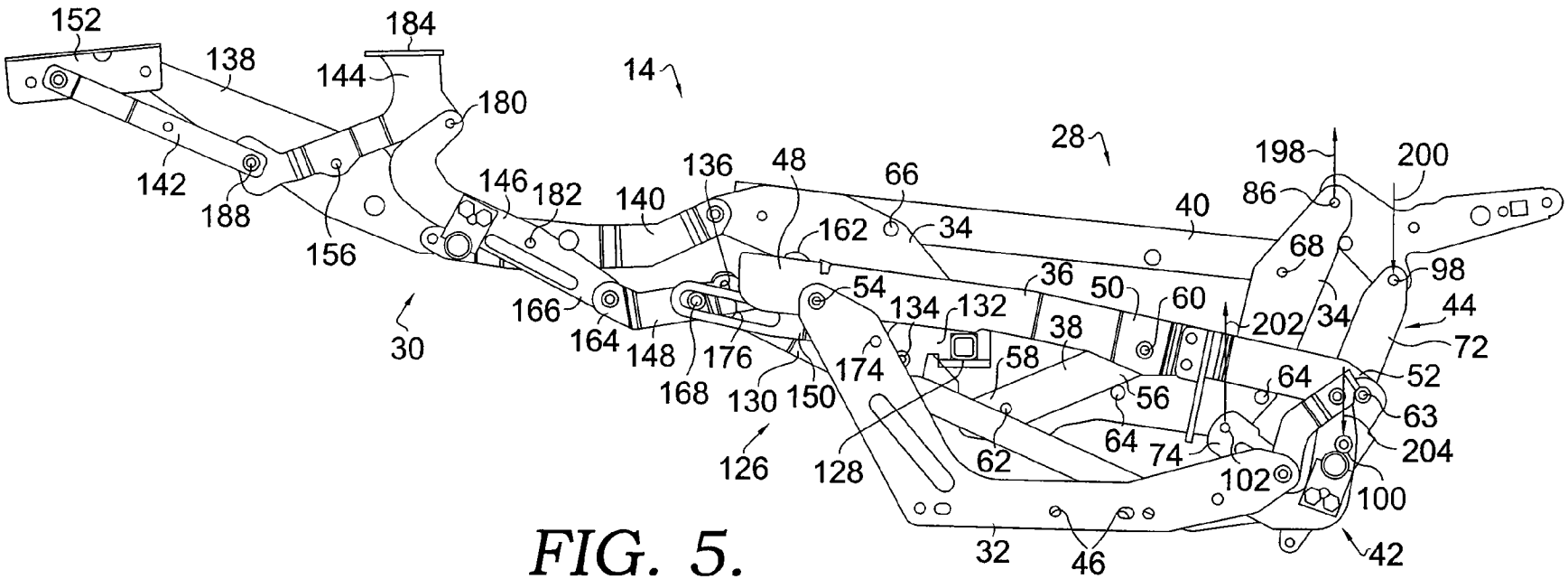
FIG. 5 is a view similar to FIG. 3, but with the linkage mechanism in an open, fully reclined position.

Generally, as best seen in FIGS. 1 and 2, the chair 10 broadly includes a base 12, and a pair of linkage mechanisms 14 mounted on the base 12. The pair of linkage mechanisms 14 are connected by a plurality of cross supports 13. The pair of linkage mechanisms 14 mount a seat 16, a pair of upstanding opposed armrests 18, a footrest 20, and a backrest 22 for movement between multiple positions. Specifically, FIGS. 2 and 3 represent the linkage mechanism 14 in the closed, chair position, position one. FIG. 4 represents the linkage mechanism 14 in the open, recliner, TV position, position two. FIG. 5 represents the linkage mechanism 14 in the open, fully reclined position, position three.

Referring now to FIG. 1, the base 12 will be discussed. The base 12 is a standard rectangular box having a pair of sidewalls 24 and a pair of cross walls 26. The pair of sidewalls 24 are spaced apart and interconnected by the pair of cross walls 26 as is understood by one of ordinary skill in the art.

Figure 6:
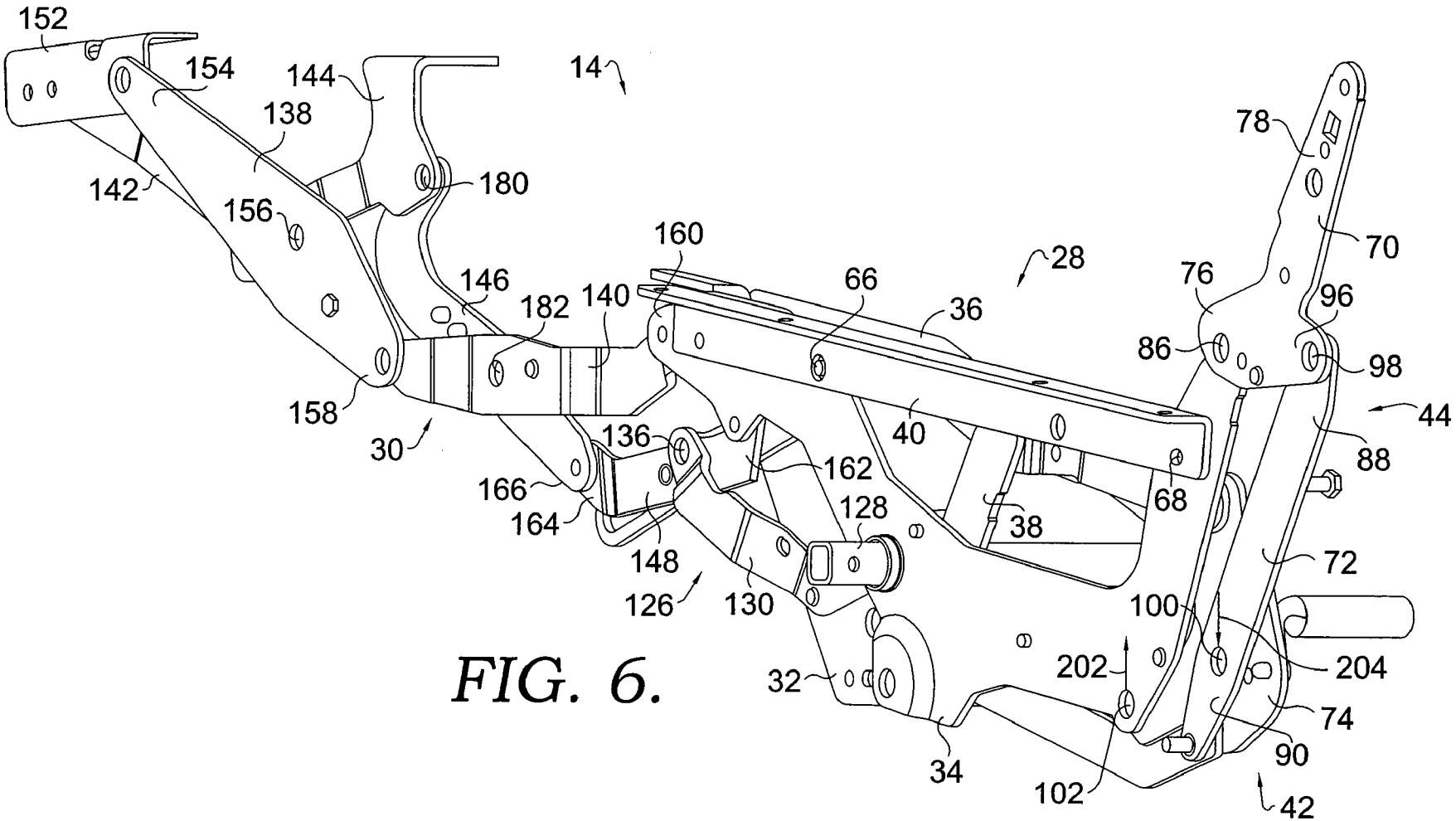
FIG. 6 is a rear perspective view of the linkage mechanism in open, recliner, TV position.

Turning now to FIGS. 2-6, the linkage mechanism 14 will be discussed. The linkage mechanism 14 broadly includes a recliner mechanism 28 and a footrest mechanism 30. As is understood by one of ordinary skill in the art, the recliner mechanism 28 is fixably coupled to the base 12. The footrest mechanism 30 is rotatably coupled to the recliner mechanism 28. FIGS. 2 and 3 show the linkage mechanism 14 in the closed, chair position, position one; with the footrest mechanism 30 in the closed position and the recliner mechanism 28 in the upright position. FIGS. 4 and 6 represent the linkage mechanism 14 in the open, recliner, TV position, position two; showing the footrest mechanism 30 in the open position and the recliner mechanism 28 in the upright position. FIG. 5 represents the linkage mechanism 14 in the open, fully reclined position, position three; with the footrest mechanism 30 in the open position and the recliner mechanism 28 in the fully reclined position. Movement between these positions will be discussed further below.

Referring now to FIGS. 3-6, the recliner mechanism 28 is discussed in detail. The recliner mechanism 28 broadly includes a base plate 32, a seat mount plate 34, a carrier link 36, a recline link 38, a lift link 40, a control linkage 42, and a back linkage 44. While not shown, it should be understood that the base plate 32 is fixably coupled with the pair of sidewalls 24 of the base 12. It should be understood that any suitable coupling method may be used The base plate 32 is an elongated piece of stamped steel, shaped as shown, with a plurality of connecting apertures 46. As shown in FIG. 5, the carrier link 36 has a forward portion 48, an intermediate portion 50, and a rear portion 52. The forward portion 48 of the carrier link 36 is coupled with the base plate 32 at connection 54. The recline link 38 contains upper and lower portions 56, 58. The upper portion 56 is coupled with the intermediate portion 50 of the carrier link 36 at connection 60 and the lower portion 58 is coupled with the seat mount plate 34 at connection 62. The rear portion 52 of the carrier link 36 is coupled with the back linkage 44 at connection 63.

The seat mount plate 34 is an elongated piece of stamped steel, shaped as shown, with a plurality of connecting apertures 64. The lift link 40 is coupled to the seat mount plate 34 at points 66, 68 and cooperates therewith to support the seat 16.

Referring now to FIGS. 2, 3, and 6, the back linkage 44 is shown. The back linkage generally includes a back bracket 70, an intermediate link 72, and a lower link 74. The back bracket 70 is generally L-shaped and includes a lower leg 76, an upper leg 78, a stop 80, and a mounting apparatus 82. A front portion 84 of the lower leg 76 is rotatably coupled to the seat mount plate 34 at point 86. The intermediate link 72 contains upper and lower portions 88, 90. The lower link 74 contains front and rear portions 92, 94. A rear portion 96 of lower leg 76 is rotatably coupled to the upper portion 88 of the intermediate link 72 at connection 98. The lower portion 90 of the intermediate link 72 is coupled with the rear portion 94 of the lower link 74 at connection 100. The front portion 92 of the lower link 74 is coupled with the seat mount plate 34 at connection 102. Again, any suitable attachment mechanism could be used. The upper leg 78 of the back bracket 70 contains the mounting apparatus 82 that is used to couple the back bracket 70 with the back 22.

Turning now to FIGS. 2 and 4, the control linkage 42 will be discussed. The control linkage 42 includes a connector link 104, a pivot link 106, and a drive link 108. The connector link 104 is shaped as shown and includes first and second ends 110, 112. The first end 110 is coupled with the base plate 32 at connection 114 while the second end 112 is coupled with the pivot link 106 at connection 116. The pivot link 106 is coupled with the lower link 74 at connection 118. The drive link 108 contains first and second ends 120, 122, the first end 120 being coupled with the pivot link 106 at connection 124 and the second end 122 being coupled with the footrest mechanism 30.

Returning to FIGS. 2, 4, and 6, and the discussion of the linkage mechanism 16, the footrest mechanism 30 is connected to the recliner mechanism 28 by a footrest extension linkage 126. It will be understood that the footrest extension linkage 126 cooperates with the footrest mechanism 30 to place the footrest mechanism 30 in an open position as best seen in FIGS. 4 and 5 and in a closed position as best seen in FIGS. 1-3. The footrest extension linkage 126 further helps the footrest mechanism 30 to remain in the open position as chair 10 moves to the fully reclined position as best seen in FIG. 5.

The discussion will next focus on the footrest extension linkage 126. As shown in FIGS. 3 and 6, the footrest extension linkage 126 generally includes a handle 127, shown in FIG. 1, a shaft 128, an ottoman link 130, and a release link 132. As shown in FIG. 2, the shaft 128 is pivotally mounted between the seat mount plates 34 on each linkage mechanism 14. The handle 127 or other activation means, not shown, is typically positioned on one side of chair 10 and is fixably mounted to shaft 128. Returning to FIGS. 3 and 6, release link 132 is fixably mounted to the shaft 128 and is rotatably coupled to the ottoman link 130 at point 134. Ottoman link 130 is rotatably coupled to the footrest mechanism 30 at point 136 as will be further described below. Thus, the ottoman link 130 serves to interconnect the release link 132 and the footrest mechanism 30.

Returning to FIGS. 4 and 6, the footrest mechanism 30 will now be discussed. The footrest mechanism 30 includes a front link 138, an upper link 140, a rocker link 142, a mid link 144, an intermediate link 146, a rear link 148, a translation link 150, and a bracket 152. The front link 138 includes a first end 154, a pivot 156, and a second end 158. The front link 138 is coupled to the bracket 152 at first end 154 and is rotatably coupled to the upper link 140 at second end 158. Opposite the connection to the second end 158, the upper link 140 is coupled to a forward portion 160 of the seat mount plate 34.

Referring now to FIGS. 4, 5, and 6, the rear link 148 contains a first end 162 coupled with the seat mount plate 34 and a second end 164 coupled with an end 166 of the intermediate link 146 and a pin 168. The transition link 150 contains an end coupled with the seat mount plate 34 at connection 174 and an elongate slot 176 that receives the pin 168. The ottoman link 130 is coupled with the rear link 148 at connection 136. The intermediate link 146 is shaped as shown and is coupled with the mid link 144 at connection 180. The intermediate link 146 is also coupled with the upper link 140 at connection 182 and, thus, forms a scissor linkage with upper link 140. The mid link 144 is shaped as shown and includes a mounting flange 184. It should be understood that the mounting flange 184 supports a portion of the footrest 20, not shown. The mid link 144 is coupled with the front link 138 at pivot 156 and the rocker link 142 at connection 188. Opposite the connection of rocker link 142 to mid link 144, the rocker link 142 is coupled with the bracket 152. The bracket 152 is generally rectangular and contains a number of apertures 190, see FIG. 2.

The operation of the recliner chair 10 is best described with reference to FIGS. 3-5. Specifically, FIG. 3 represents the recliner chair 10 in the closed, chair position, position one; with the footrest mechanism 30 in the closed position and the recliner mechanism 28 in the upright position. FIG. 4 represents the recliner chair 10 in the open, recliner TV position, position two; with the footrest mechanism 30 in the open position and the recliner mechanism 28 in the upright position. FIG. 5 represents the recliner chair 10 in the open, fully reclined position, position three; with the footrest mechanism 30 in the open position and the recliner mechanism 28 in the fully reclined position.

Referring now to FIGS. 4 and 5, if the occupant desires to convert from position one to position two, the user rotates the handle 127 or other activation means, not shown, rearwardly. Rearward rotation of the handle 127 or other activation means, in turn, causes a downward rotation of the release link 132 coupled thereto through shaft 128. The downward rotation of the release link 132 unlocks the ottoman link 130. Once the ottoman link 130 is unlocked, the weight of the user causes the recliner mechanism 28 to move forward.

In addition, the control linkage 42 also assists in moving the footrest extension linkage to the extended position. Once the footrest extension linkage has been released, the pivot link 106 rotates in a clockwise manner, with reference to FIGS. 3 and 4, about connection 116. This clockwise motion of the pivot link 106 moves the drive link 108 toward the front of the recliner 10. This translation of the drive link 108 assists in moving the footrest mechanism 30 to the open position and the linkage mechanism 14 to the recliner TV position, position two, as shown in FIG. 6. It should be understood that the footrest mechanism 30 may be returned to position one from position two by either turning the handle or other activation means in the opposite direction or by applying a downward force, as shown by reference numeral 192 on footrest 20, not shown, attached to bracket 152. The clockwise motion of the pivot link 106 also causes the lower link 94 of the back linkage 44 to move downwardly thereby causing a rear portion 194 of the lift link and, thus, the seat to move downwardly.

Referring now to FIGS. 4 and 5, to move from position two, shown in FIG. 4 to position three, shown in FIG. 5, an additional force as represented by reference numeral 196 is applied to back bracket 70 via back 22, (not shown). The force 196 applied to the back bracket 70 causes a clockwise rotation, with reference to FIGS. 5 and 6, of back bracket 70. The clockwise motion of back bracket 70 causes an upward pulling force at point 86, represented by reference numeral 198, and a downward pushing force at connection 98, represented by reference numeral 200. The rotation of the back bracket 70 and the downward force 200 on the intermediate link 72, in turn, causes a downward force 204 on the lower link 74 through connection 100 as shown in FIG. 5. As shown in FIGS. 5 and 6, the downward force 204 on the lower link 74 through connection 100 causes the lower link 74 to rotate about 102. The rotation of the lower link 74 causes the seat mount plate 34 to move upwardly as represented by arrow 202. The upward movement of the seat mount plate 34 causes the lift link 40 and, thus, the seat 16, attached thereto, to move upwardly.

The present invention has been described in relation to particular embodiments, which are intended in all respects to be illustrative rather than restrictive. Alternative embodiments will become apparent to those skilled in the art to which the present invention pertains without departing from its scope.

It will be seen from the foregoing that this invention is one well adapted to attain the ends and objects set forth above, and to attain other advantages, which are obvious and inherent in the device. It will be understood that certain features and subcombinations are of utility and may be employed without reference to other features and subcombinations. This is contemplated by and within the scope of the claims. It will be appreciated by persons skilled in the art that the present invention is not limited to what has been particularly shown and described hereinabove. Rather, all matter herein set forth or shown in the accompanying drawings is to be interpreted as illustrative and not limiting.

What is claimed is:

1. A linkage mechanism for a recliner chair having a footrest, a seat, back, a base, and a pair of spaced apart armrests, the linkage mechanism comprising:

a recliner mechanism comprising:

a base plate first and second ends, the base plate being fixedly coupled to the base that supports the recliner mechanism above an underlying surface;

a carrier link having first and second ends, the first end of the carrier link being coupled with the first end of the base plate;

a recline link having first and second ends, the first end being coupled with the carrier link at a position intermediate the first and second ends of the carrier link;

a seat mount plate having a forward portion and a rear portion; the second end of the recline link being coupled with the seat mount plate at a position intermediate the forward and rear portions;

the back linkage comprising:

a back bracket pivotably coupled with the rear portion of the seat mount plate and to an upper portion of an intermediate link;

the intermediate link having the upper portion and a lower portion;

a lower link having a front, rear, and upper portion, the front portion pivotably coupled to the rear portion of the seat mount plate, the rear portion being pivotably coupled to lower portion of the intermediate link, and the upper portion being pivotably coupled to the second end of the carrier link; and a footrest mechanism coupled with the front portion of the seat mount plate;

wherein the recliner mechanism operates to move the chair between a first position and a second position, and the second position and a third position; and wherein the interconnection of the recline between the carrier link and the seat mount plate causes the rear portion of the seat mount plate to rise at a greater rate than the forward portion of the seat mount plate when adjusting the recliner mechanism from the second position to the third position.

2. The linkage mechanism of claim 1, further comprising a lift link coupled with the seat mount plate at spaced-apart positions, the lift link mounting to the seat.

3. The linkage mechanism of claim 2, wherein the recliner mechanism is configured such that the carrier link moves downwardly relative to the lift link when the chair moves between the second position and the third position.

4. The linkage mechanism of claim 1, wherein the coupling between the back linkage and the rear portion of the seat mount plate is configured to induce pivotable motion of at least a portion of the back linkage to move the chair between the second position and the third position.

5. The linkage mechanism of claim 4, wherein movement of the recliner mechanism to the third position is resisted when the footrest mechanism is adjusted to the first position.

6. The linkage mechanism of claim 4, wherein back bracket pivotably coupled with the rear portion of the seat mount plate enables the motion of the back linkage to generate a pivoting of the back bracket causing the back bracket to pivot about the seat mount plate and thereby generating a downward adjustment of the intermediate link, wherein the downward adjustment of the intermediate link rotates the lower link about the seat mount plate thereby moving the carrier link downward and rearward relative to the seat mount plate.

* * * * *